US006341933B1

(12) United States Patent
Gagnon et al.

(10) Patent No.: US 6,341,933 B1
(45) Date of Patent: Jan. 29, 2002

(54) HINGED SCOOP END-EFFECTOR

(75) Inventors: Eric Gagnon, Brampton; Bruno Rubinger, North York, both of (CA)

(73) Assignee: MacDonald Detwiler Space & Advanced Robotics Limited

( * ) Notice: Subject to any disclaimer, the term of this patent is extended or adjusted under 35 U.S.C. 154(b) by 0 days.

(21) Appl. No.: 09/325,640

(22) Filed: Jun. 4, 1999

(51) Int. Cl.[7] ..... E02F 3/00
(52) U.S. Cl. ..... 414/725; 37/411; 414/729
(58) Field of Search ..... 414/722, 725, 414/729; 37/411, 142.5

(56) References Cited

U.S. PATENT DOCUMENTS

| | | | | |
|---|---|---|---|---|
| 3,195,747 A | | 7/1965 | Kashergen | |
| 3,369,834 A | | 2/1968 | Miles | |
| 3,581,924 A | | 6/1971 | Marz et al. | |
| 3,921,316 A | | 11/1975 | Moreau | |
| 4,286,417 A | | 9/1981 | Shelton | 51/415 |
| 4,321,761 A | | 3/1982 | Hedblom | 37/2 |
| 4,848,484 A | | 7/1989 | Clements | 175/20 |
| 4,928,410 A | | 5/1990 | Walters et al. | 37/117 |
| 5,281,079 A | | 1/1994 | Lemelson | 414/744 |
| 5,427,424 A | | 6/1995 | Robinson | 294/50.9 |
| 5,478,128 A | | 12/1995 | Aaland | 294/50.8 |
| 5,570,992 A | | 11/1996 | Lemelson | 414/744.3 |
| 5,702,227 A | | 12/1997 | Berg | 414/704 |
| 5,743,030 A | | 4/1998 | Sirr | 37/142 |
| 5,885,053 A | * | 3/1999 | Deye | 414/725 X |

FOREIGN PATENT DOCUMENTS

| | | | | |
|---|---|---|---|---|
| DE | 1814391 | * | 7/1969 | 414/722 |

* cited by examiner

*Primary Examiner*—Donald W. Underwood
(74) *Attorney, Agent, or Firm*—David J. French

(57) ABSTRACT

An end-effector comprises a circulating scoop that cooperates with a plate that lies in its arcuate path. The plate spans the arcuate gap present within the scoop and preferably may be contained within that gap. The plate may be positioned to provide a bucket-like cavity facing in either fore or aft directions. The scoop and/or plate can carry indentations whereby they grasp shaped articles for controlled manipulation.

18 Claims, 9 Drawing Sheets

HINGED SCOOP END-EFFECTOR

FIELD OF THE INVENTION

This invention relates to an end-effector for a robotic mechanism. More particularly, it relates to a scoop or bucket-like attachment for capturing and picking-up friable material, such as soil. It also relates to a versatile end-effector for grasping articles.

BACKGROUND TO THE INVENTION

In the field of earth moving diggers, diggers have been provided with scooping shovels that have a bucket with a hinged bottom panel. The bottom panel closes up against the edges of the bucket to provide a floor for the bucket. This design was particularly common with steam-powered shovels and is still used in many petroleum-powered earth moving machines.

In designs based on a scoop having a shovel/bucket fixed to an arm with the floor panel being hinged, penetration of the scoop into soil has been effected by manipulation of the bucket through the supporting arm.

As well, shovel buckets have been attached to a supporting arm by hinged joints, with provision to actuate the bucket itself to perform claw-like functions. In this latter arrangement, the bucket is generally of a monolithic form i.e. the bottom panel and sidewalls are integral. In many configurations the jaws of a pair of such "clam" buckets close together until their teeth abut against each other.

In both of the described cases reliance is placed on the weight of the arm to break into material that is to be gathered. In earth-moving equipment, the weight of the arm is substantial and by merely dropping the arm under gravity, sufficient force can be applied to provide a penetrating effect.

In robotic applications wherein a vehicle is provided with an arm with a scoop to collect samples of material through remote actuation, the vehicle may not be of significant mass. Similarly, the arm may also be of light-weight. This is particularly true of extra terrestrial exploration vehicles that are necessarily of light weight in a low gravity environment.

A need exists for an end-effector arrangement based upon a light weight supporting arm that is nevertheless able to apply adequate disruptive breaking forces to material that is to be collected. Such an end-effector should be versatile in its capacity to gather and contain material being collected while nevertheless being relatively simple in design. As well, it would be desirable to enable such an end-effector to grasp articles that are adapted to be engaged by the end-effector. The present invention addresses these objectives The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to one aspect of the invention an end-effector carried by a supporting arm is in the form of a bucket that has an actuated scoop as one portion and a non-actuated plate as a second portion. The scoop lacks an enclosing end wall and is defined instead by its side and circumferential wall only.

The plate, which is able to serve as a "floor" for the bucket, is fixed to the arm at some convenient position. The scoop is manipulated by causing it to rotate towards, and preferably around the plate. To achieve this effect, the scoop is hinged to swing in an arcuate path that allows the scoop to be positioned so the plate serves as a "floor". The scoop may abut the plate, or pass around the plate with a sliding fit. The plate in this latter case serves as a partitioning wall inside a hinged, torus-like scoop segment that may be swung so as to envelop the plate.

As a preferred arrangement, the scoop can be arrested at a position whereat the plate serves as a floor portion at one end of the bucket. The scoop may also be arrested at a position wherein the plate is located intermediate the scoop's front and back edges. Or it may be located at the other end of the scoop. In this manner a bucket cavity may be formed that opens outwardly in either of two, opposed directions.

The plate is carried by the arm, generally in a fixed orientation with respect to the arm. In use, the plate may be variously oriented horizontally or vertically by positioning of the arm. In one application the plate may be positioned so that it is substantially aligned with the supporting arm. Both of these components may then be placed in a vertical alignment and pressed into the ground in the manner of a spade.

Next, the scoop may first be elevated and then descended in an arc towards the plate. To the extent that material of the surface to be sampled lies above the lower edge of the plate, it will be severed from that surface upon which it lies and contained within the scoop. The scoop may then be closed to capture material which is located adjacent to the plate. Such material, e.g. soil, will then be contained by the circumferential, outer, curved surface of the scoop. The plate also serves to contain material in cooperation within the scoop, preventing it from falling out of the end of the scoop by closing-off one end of the scoop.

The plate may be attached to the supporting arm, at a fixed orientation, or its orientation with respect to the arm may be adjustable. It may also be controllable in the sense of being actuated. An adjustable coupling for the plate may be effected through use of a hinged connection to the arm that includes a locking system that will fix the plate at differing, "indexed", orientations with respect to the arm. In an aligned orientation, the plate and arm can function as a "shovel".

The plate need not be flat. It may be cylindrically curved, for example. The scoop, as well, need not be of circular cross-section. It is sufficient that the edges of the plate fit closely enough to the scoop to provide a containment function when they are interfitted with each other.

The plate and scoop may share a common hinge axis. Alternately, the plate may be separately mounted to the arm by supporting means that extends laterally past the hinge of the scoop to connect to the arm.

While the plate need not be actuated, it is intended that the circumferentially moving scoop be actuated. The scoop preferably may be swung in an arc about its axis that may extend up to nearly 360° or more. In passing along this curved trajectory, the scoop is able to pass around the plate entirely. By arresting the scoop at appropriate locations with respect to the plate, a bucket cavity can be formed on either side of the plate portion.

In more secure operations where spillage is undesirable, a second partitioning panel, providing a second end-wall function to compliment the role of the plate, may be carried by the arm. Such second panel may be both hinged and actuated so as to, when closed on the scoop, form a fully contained cavity within the scoop. With such a cavity so formed, the supporting arm may convey the sampled material without the same orientation restraints that would be present if the bucket were open at one end. This type of arrangement is especially suited to the gathering of contaminating material which should not he dropped during transport.

By a further feature of the invention, the scoop and plate may adapted to provide a self-aligning, tool grasping interface allowing the grasping and constraining of articles. This may be effected by providing cooperating notches along the edges of the scoop and/or plate that are positioned to cooperate in engaging with articles that are to be grasped.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
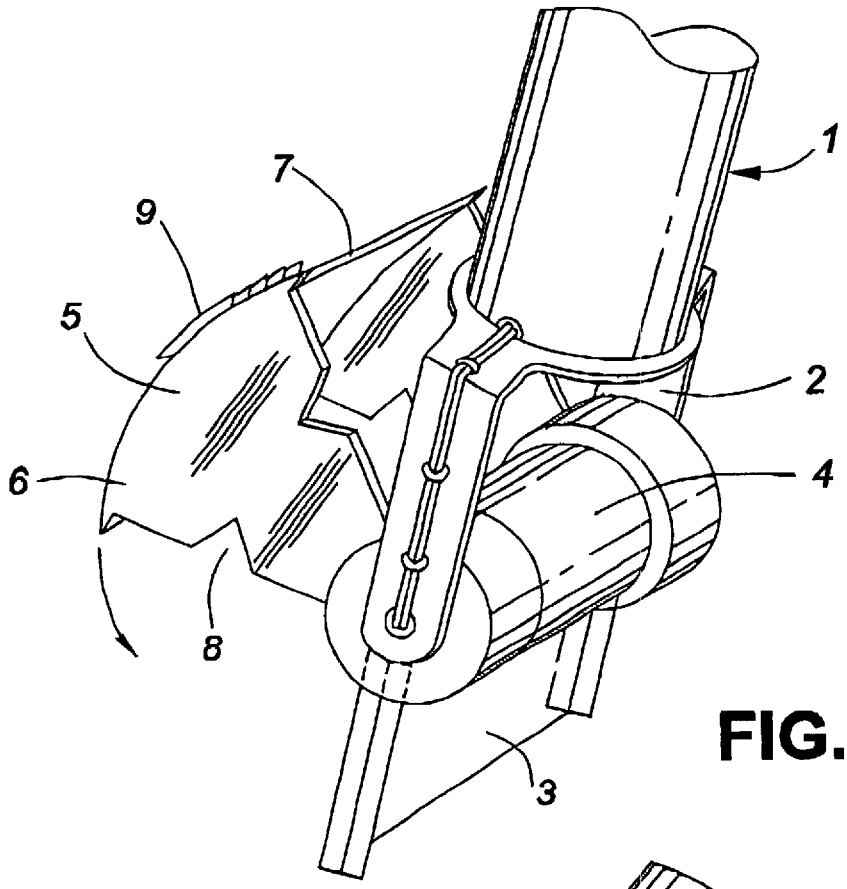
FIG. 1 is a pictorial perspective view of the end effector of the invention with the plate deployed and the scoop in elevated position.

In FIG. 1 an arm 1 carries a yoke 2 from which extends a plate 3. While shown as a full "y"-shaped yoke, a half-yoke would suffice. Contained within the yoke 2 is an axial motor 4 which serves to actuate the scoop 5. The motor 4 may contain a gear assembly 4*a* to provide increased torque.

Figure 1A:
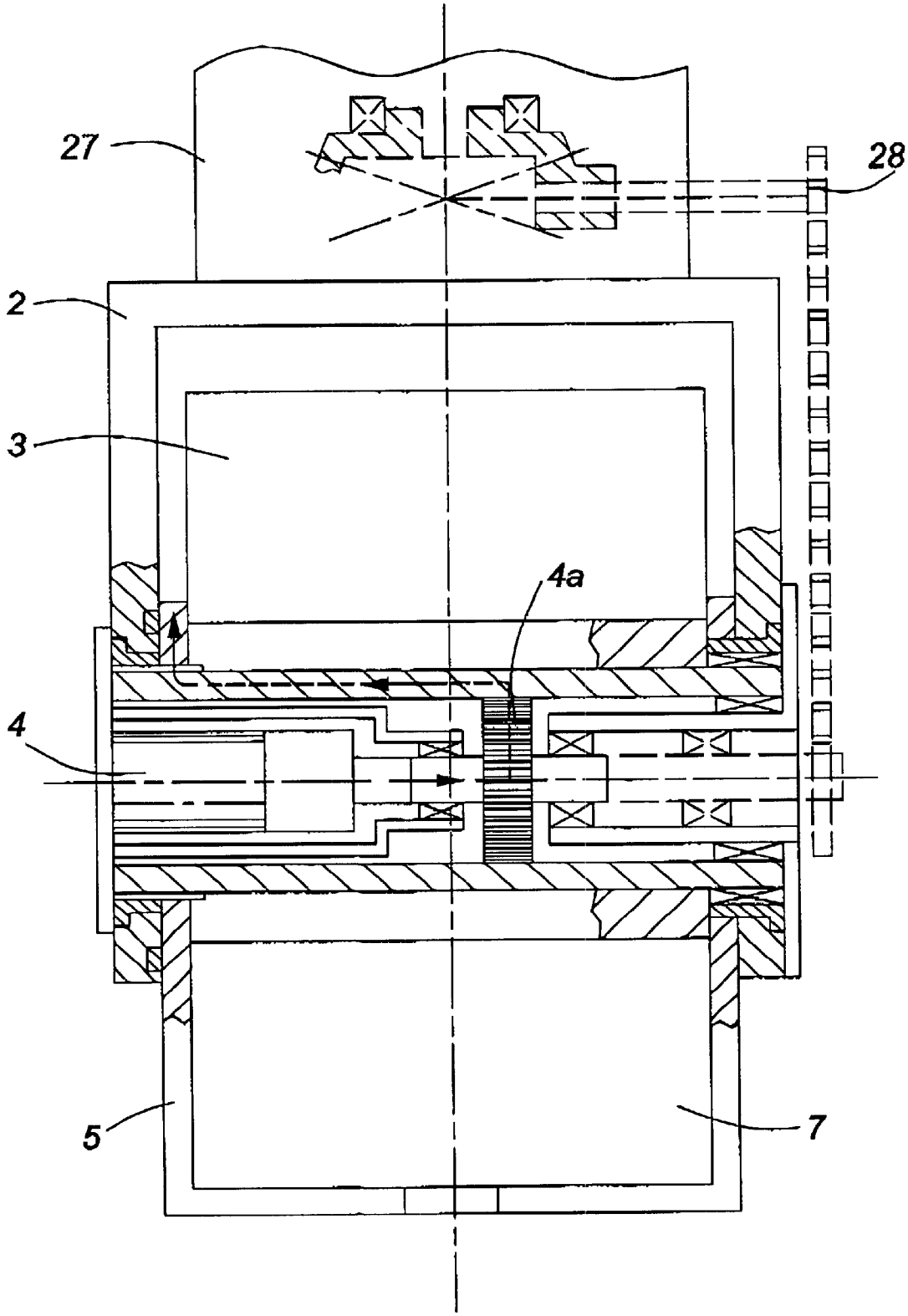
FIG. 1*a* is a cross-sectional view of the scoop and plate of FIG. 1 depicting an axially-mounted motor with an alternate arm-mounted motor and linkages shown in ghost outline.

Activation may also be provided from an actuator 27 mounted elsewhere, as on the arm 1, and connected by rotary and/or chain linkages 28 to the scoop 5. This is shown in ghost outline in FIG. 1*a*, which figure also shows the axially-mounted motor 4 coupled between the yoke 2 and scoop 3.

The scoop 5 has two side panels 6 and a preferably arcuate bottom plate 7. The edges of these parts may have notches 8 to allow for grasping of objects as further described below.

Figure 2:
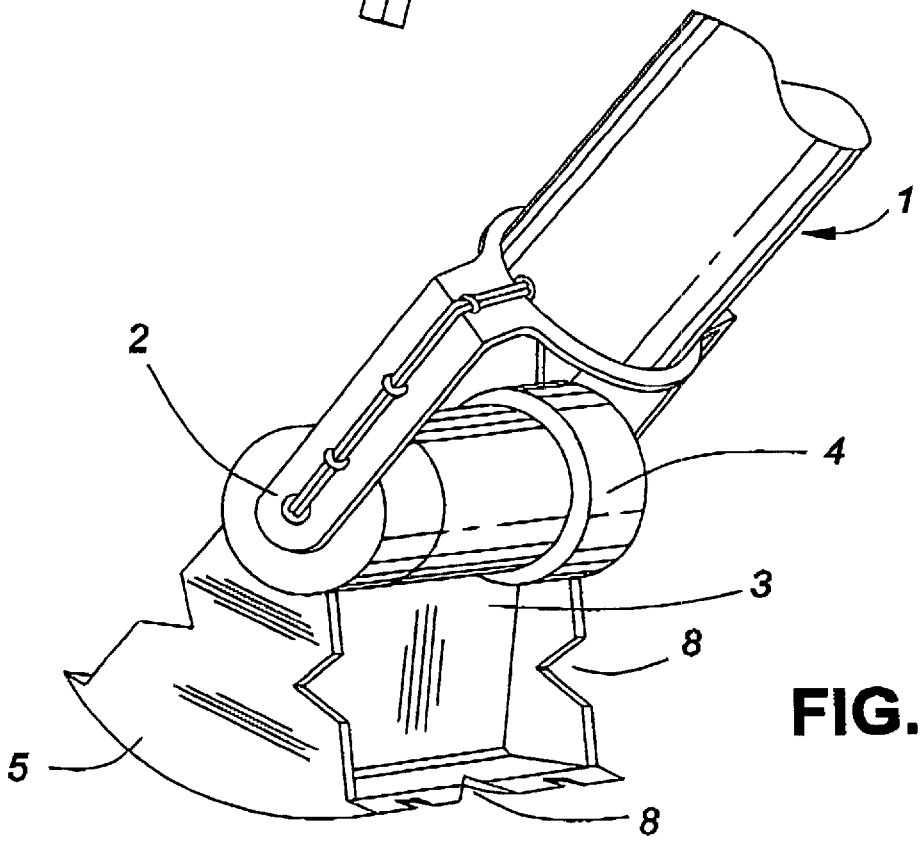
FIG. 2 depicts the arrangement of FIG. 1 with the scoop rotated to enclose the plate portion and the plate respositioned with respect to the arm.
Figure 2A:
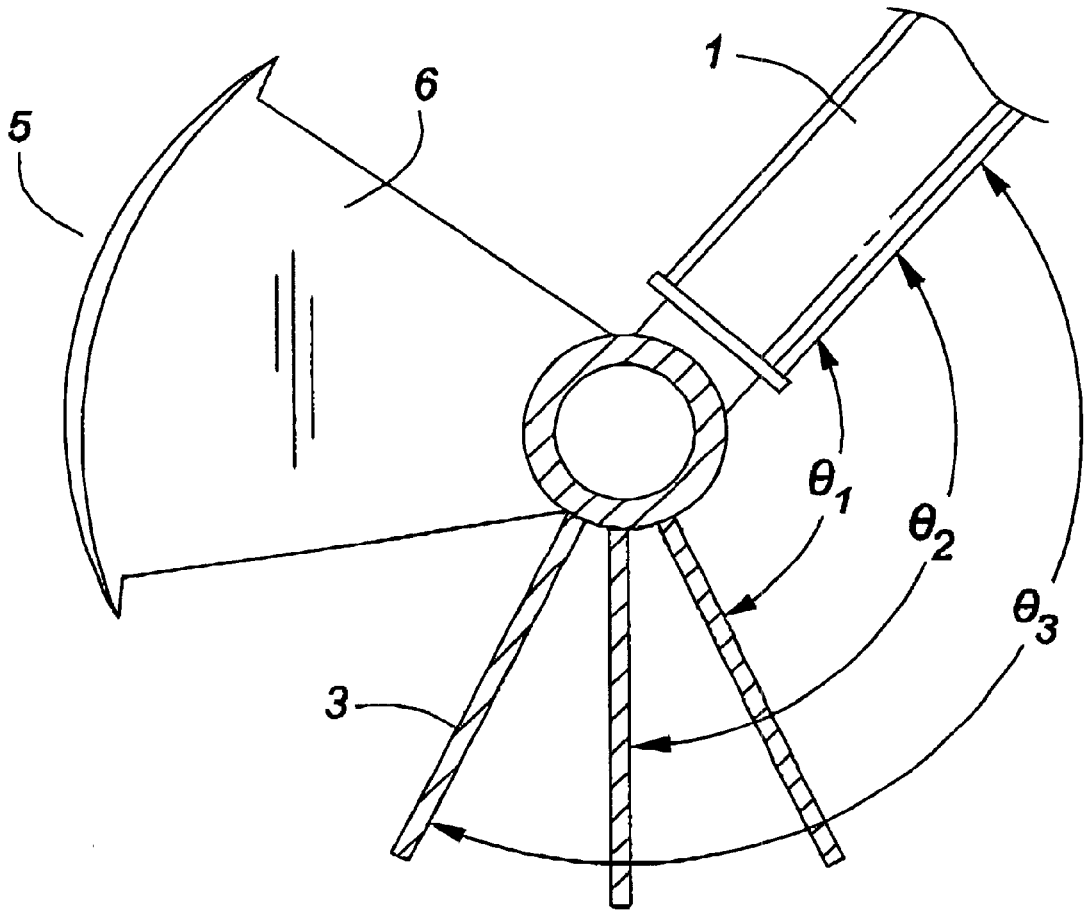
FIG. 2*a* is a cross-sectional schematic depiction of the scoop and plate of FIG. 1 showing the plate at various fixed, indexed positions.

The plate 3 is shown in FIG. 1 as aligned with the arm 1. This is optional. The plate 3 may be angled with respect to the arm 1, as shown in FIGS. 2 and 2*a*. The alternate orientations of the plate 3 depicted in FIG. 2*a* represent fixed positions to which the plate 3 may be shifted manually or by other means, such as by manipulation of the arm 1 while the plate 3 is engaged with a surface. Engagement means allow the plate 3 to be locked in various orientations.

The scoop 5 swings on an arc that allows it to embrace the plate 3. The outside face of the plate 3 may carry scarifying blades 9 to allow the scoop 5 to loosen material that is crusty. The blades 9 are shown in FIGS. 1 and 3 as sharp, continuous edges, but may be of various forms, e.g. interrupted, sinuous.

Figure 3A:
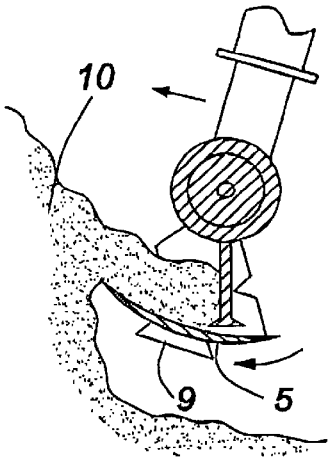
FIGS. 3*a*, 3*b* and 3*c* are cross-sectional side views of the end-effector progressively acting in front-loading mode, in back-loading mode and in dumping mode.
Figure 3B:
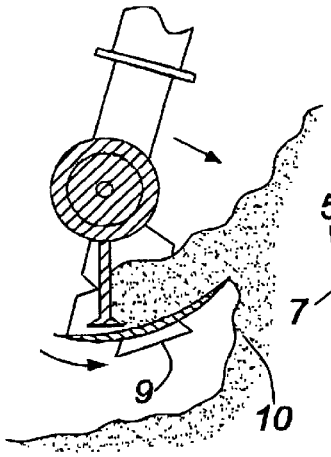
Figure 3C:
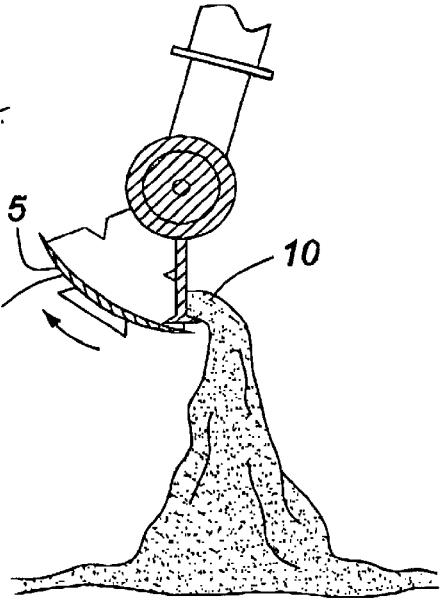

In FIG. 3*a* the scoop 5 is shown advancing in front-loading mode into an elevated bank of soil 10. In FIG. 3*b*, the scoop 5 is being swung in the reverse direction to enter soil 10 in back-loading mode. In FIG. 3*c*, soil obtained as in FIG. 3*b* and carried on the bottom plate 7 is being dumped by the action of causing the scoop 5 to retire. In this FIG. 3*c*, the plate 3 scrapes the soil 10 off the bottom as the scoop 5 passes along its retiring arc.

Figure 3D:
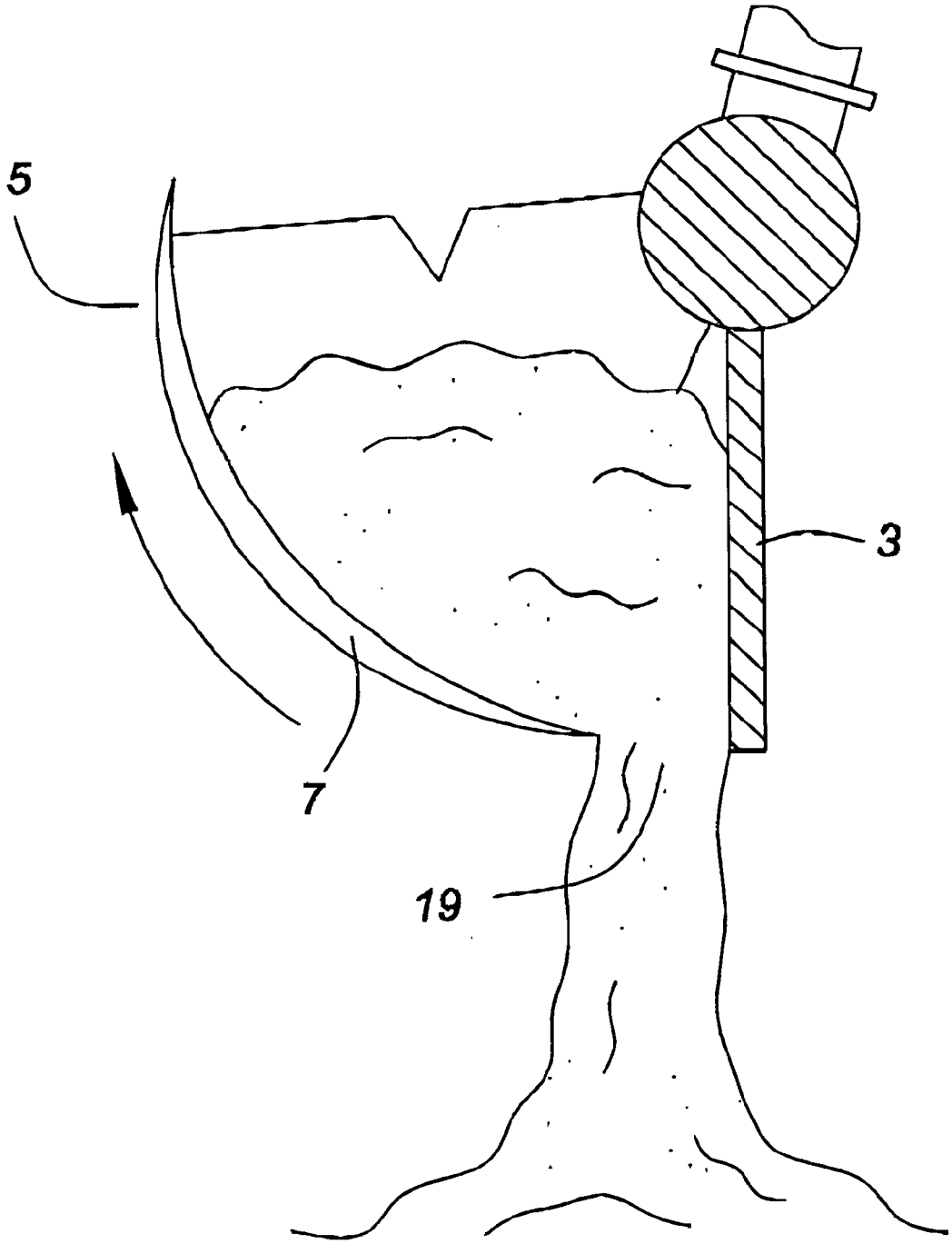
FIG. 3*d* shows the end-effector of FIG. 3*b* with the scoop advanced to provide a slot for controlled release of flowing material.

Optionally, in FIG. 3*d*, the scoop may be swung outwardly to open a gap 19 to more controllably release soil 10 in the gap 19 created between the plate 3 to the outwardly moving scoop bottom plate 7. The gap 19 with may be widened or narrowed to provide for fast or slow soil release.

Figure 4A:
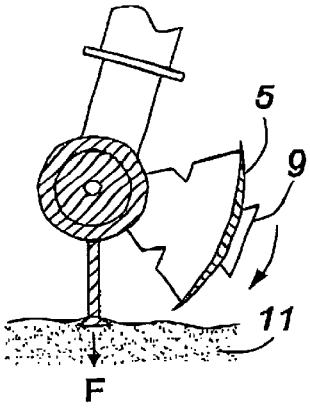
FIGS. 4*a*, 4*b* and 4*c* are progressive cross-sectional side views of the end effector as the scoop is rotated to penetrate vertically into a soil surface.
Figure 4B:
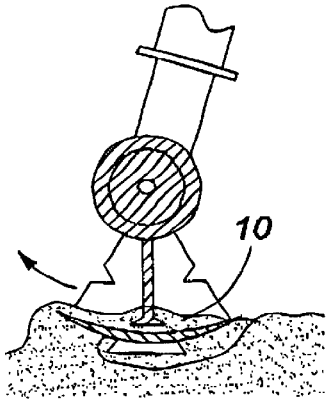
Figure 4C:
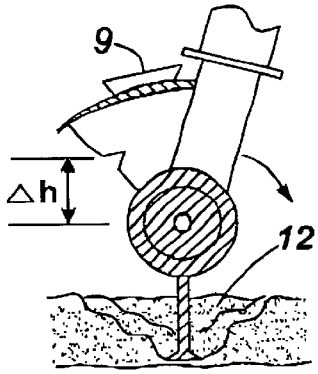

In FIGS. 4*a*, 4*b* and 4*c* the scoop 5 progressively penetrates a flat surface 11 that, optionally, has first been loosened by the scarifying blades 9. In FIG. 4*a* the plate 3 is pushed into the soil 10 in the manner of a spade. Once a first amount of soil 10 has been removed, the bottom plate 3 may be inserted in the depression 12 so formed, and the scoop 5 may attack the sides of the depression 12, as shown in FIG. 4*c*.

Figure 5A:
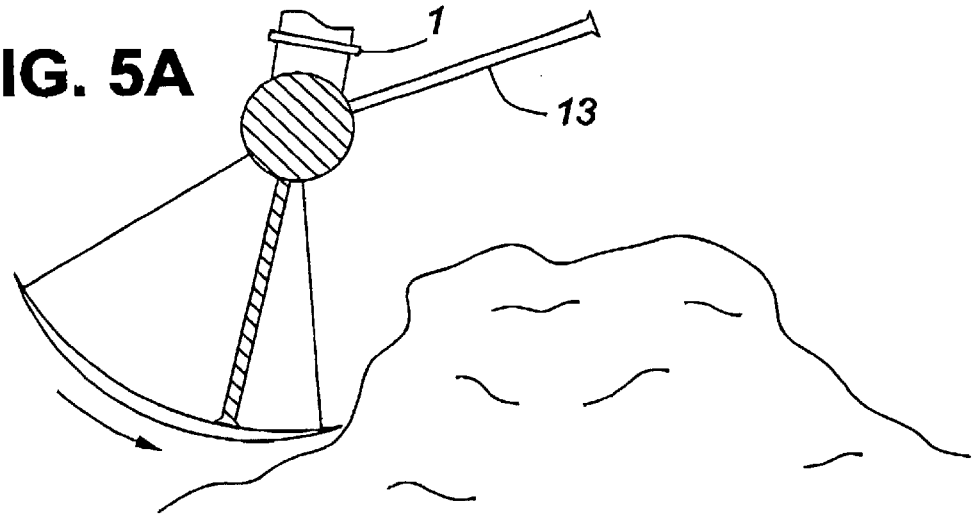
FIGS. 5*a*, 5*b* and 5*c* are cross-sectional side views of the end-effector equipped with a second, hinged and actuated containment panel, progressively depicting the entrapment of contaminating soil.
Figure 5B:
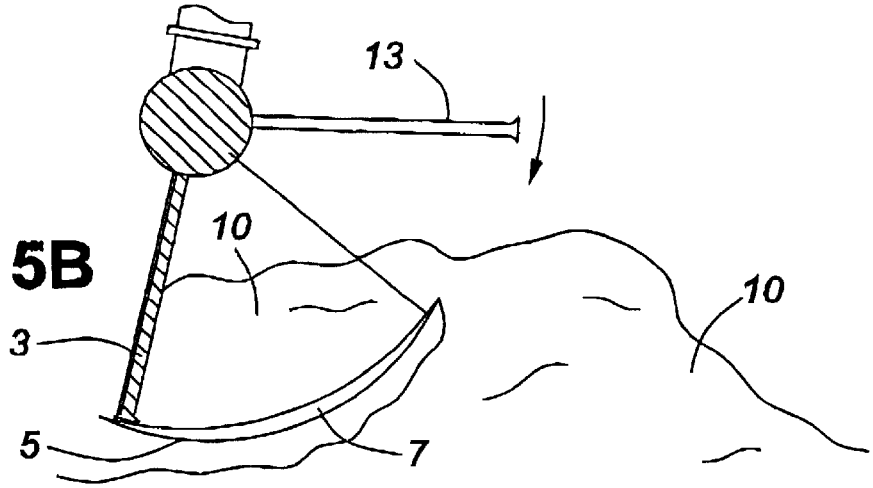
Figure 5C:
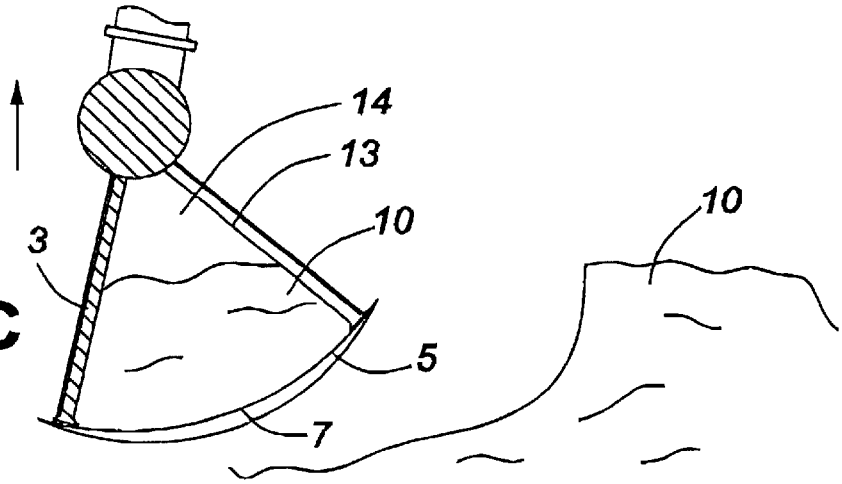

In FIGS. 5*a*, 5*b* and 5*c* an additional containment panel 13 is carried by the arm 1. This additional panel 13 is both hinged and actuated with respect to the yoke 5. In FIG. 5*a* the additional panel 13 is elevated to be parked in a standby location. In FIG. 5*b* the scoop 5 has penetrated soil 10, advancing soil 10 onto the bottom plate 7. At this stage, the containment panel 13 is commencing to swing downwardly.

In FIG. 5*c* a cavity 14 has been formed within the scoop 5 by the bottom plate 7, the containment panel 13, the plate 3 and the side panels 6. Within the cavity 14, so formed, soil 10 may be carried with greater security against the risk of contaminating the environment.

Figure 6A:
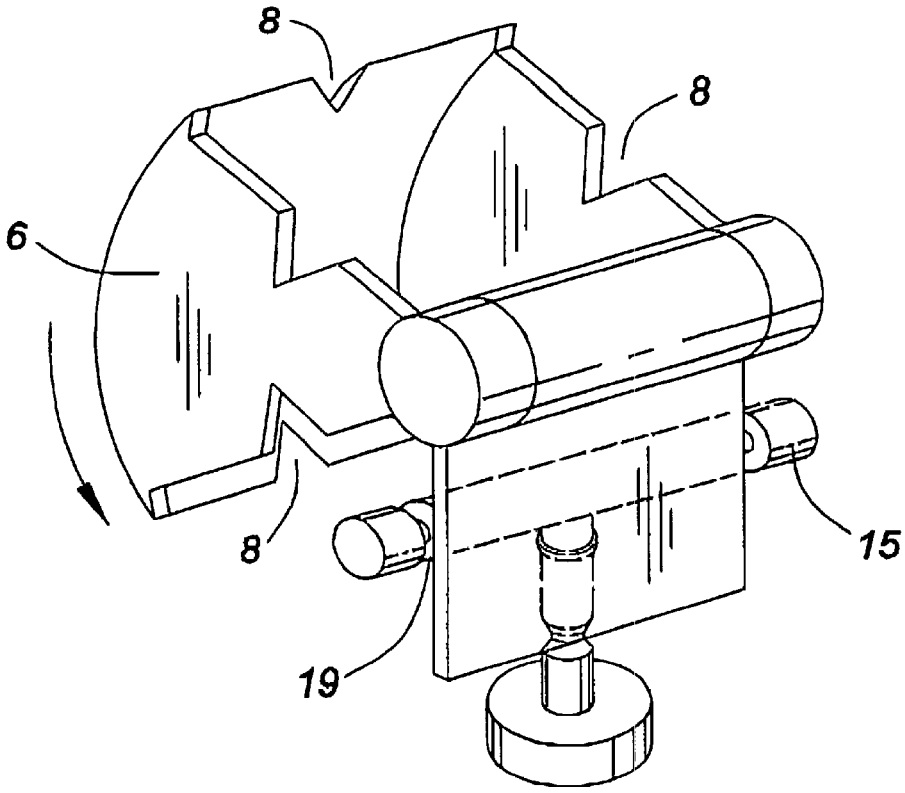
FIGS. 6*a* and 6*b* depict the end effector of FIG. 1 equipped with indentations on the edges of the scoop to enable a shaped article such as a grapple fixture to be grasped.
Figure 6B:
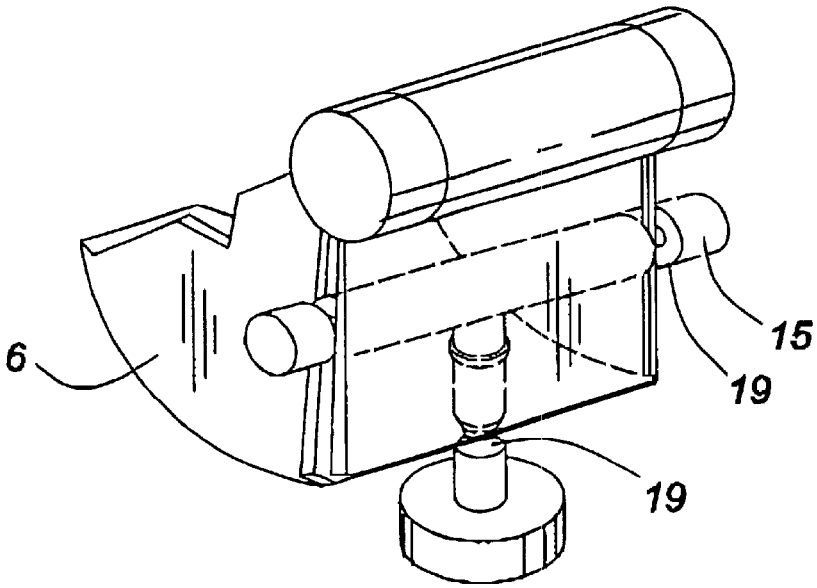

FIG. 6*a* depicts the scoop 5 engaging a shaped grapple fixture 15 using the notches 8 present along the edges of the bottom 7 and side 6 plates. As the scoop 5 closes on the indented arms of the grapple fixture 15, the fixture 15 will be pressed against the plate 3 and grasped as shown in FIG. 6*b*. Conical indentations 19 on the grapple fixture 15 are positioned to self-align and fit precisely with the notches 8 on the scoop 5. The scoop 5 and/or plate 3 may also carry electrical sockets to engage with connectors associated with the grapple fixture 15. By this means grasped objects capable of actuation can, in turn, be controlled.

Figure 7A:
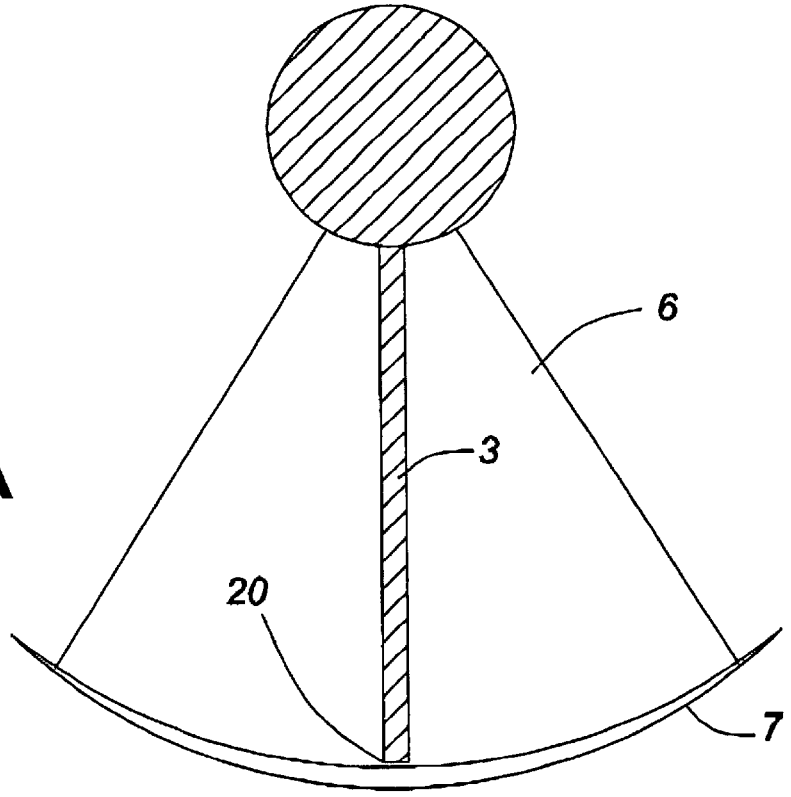
FIG. 7*a* is a cross-sectional view of the scoop and plate portions of the end effector showing the plate with a blunt distal edge.
Figure 7B:
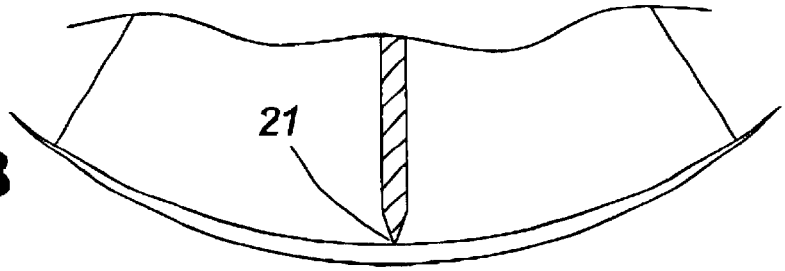
FIGS. 7*b*, 7*c* and 7*d* show progressively enlarged details of optional alternatives to the blunt edge of FIG. 7*a*, specifically a sharp edge, an enlarged, beaded edge and a brush-lined edge.
Figure 7C:
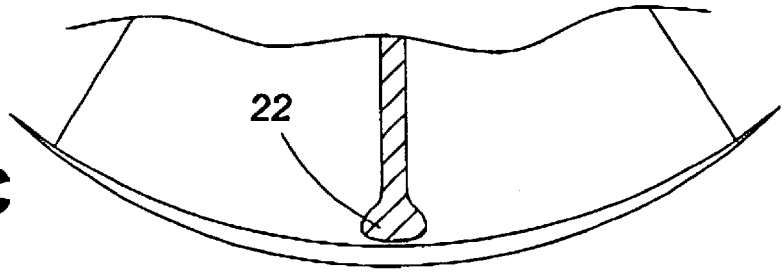
Figure 7D:
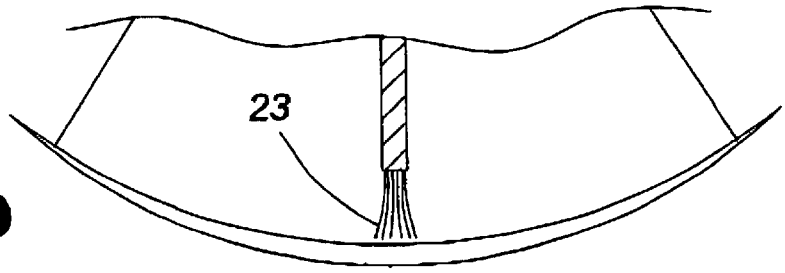

The edges of the plate 3 preferably just lie along the surfaces of the scoop 5 as the scoop 5 is rotated. In particular, the distal edge 20 of the plate 3 may be blunt, FIG. 7*a*; sharpened 21, FIG. 7*b*; enlarged or beaded 22, FIG. 7*c*; or it may be compliant and flexible as when lined with a brush 23, FIG. 7*c*.

Figure 8:
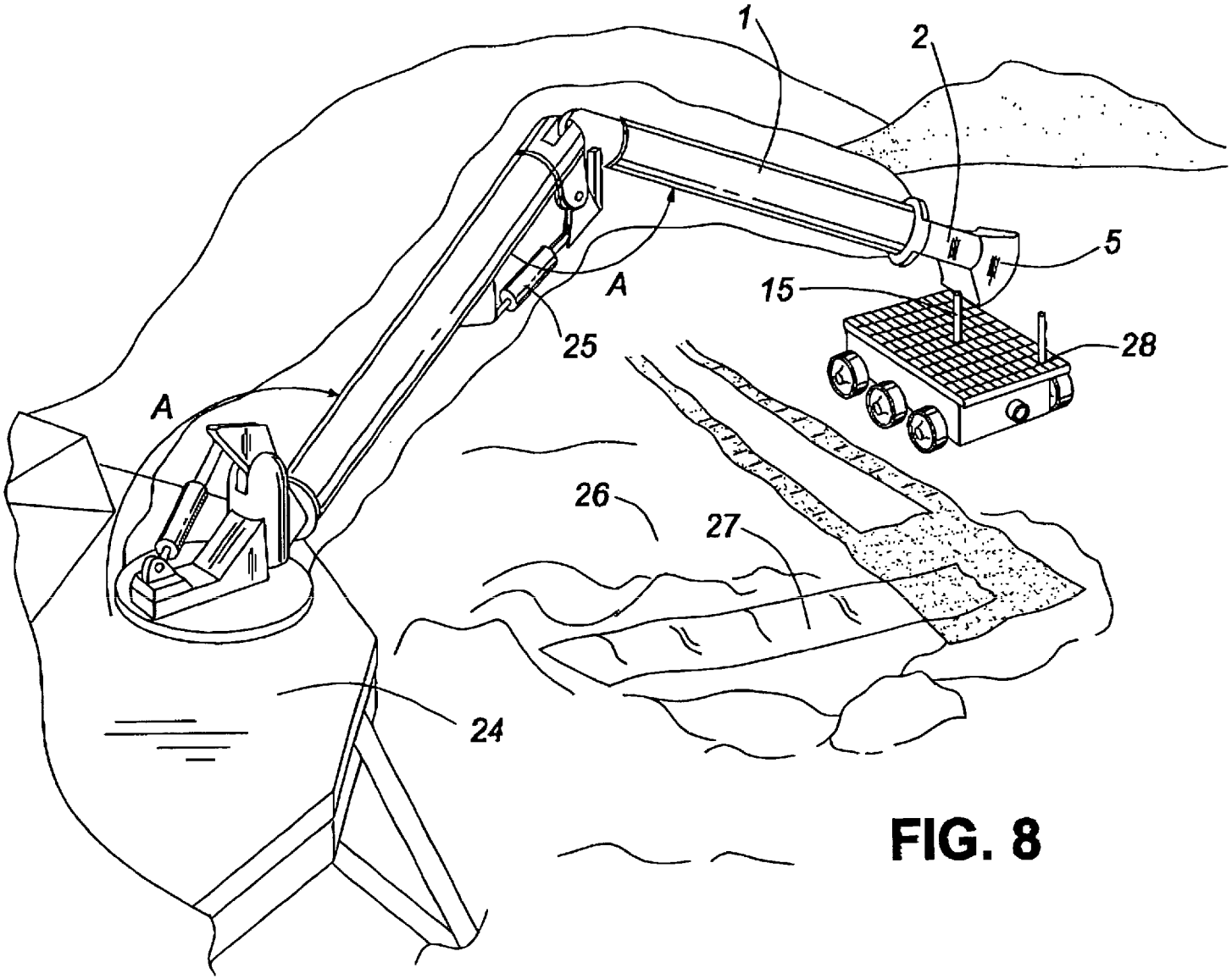
FIG. 8 is a pictorial depiction of the end-effector at the end of a support arm mounted on an extra terrestrial lander, with the end-effector delivering (or retrieving) a mobile vehicle located on the surface adjacent the lander.

While the end-effector of the invention is inherently suited for use on a light vehicle, it may be operated from a solid platform, such as the extra terrestrial lander 24 of FIG. 8. Actuators 25 on the arm 1 may position the scoop 5 and plate 3 for transfer of soil 10 from the surface 26 to the lander 24. A trench 27 on the surface 23 which has previously been excavated by the end-effector of the invention is shown in this FIG. 8. FIG. 8 also depicts the end-effector seizing a mobile vehicle 28 by a grapple fixture 15 to place it at a desired location on the surface 26.

Thus, a versatile and light-weight end-effector may be provided which can serve both to gather and deliver friable material, and to grasp suitably shaped articles for reliable remote manipulation.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property are claimed as follows:

1. An end effector carried by a supporting arm, said end effector comprising:

a. mounting means extending between said end effector and the supporting arm, said end effector, having a first plate member held at an orientation relative to said support arm;

b. a hinged rotatable second plate member carried by said support arm;

c. a rotatable scoop rotatably mounted by said support arm, said scoop having a pair of opposed lateral side walls and a curved arcuate bottom member defining an obstruction free, arcuately-shaped, open-ended scoop, said scoop being adapted to rotate through at least a portion of an arc to allow at least one of said first and second plate member to span said opening of said scoop between said lateral side walls; and d. actuation means for rotating said rotatable scoop portion and said second plate member about said hinge.

2. An end effector according to claim 1, wherein said rotatable scoop portion is moveable about its axis in an arc that equals or exceeds 360 degrees.

3. An end effector according to claim 1, wherein said first plate portion is adjustably mounted for positioning in selected fixed orientations with respect to said supporting arm.

4. An end effector according to claim 1, wherein said second plate member is sized to span an open end of said scoop between said side walls such that when said second plate member is in a position adjacent said side walls, said second plate being positionable to forming with said side walls, said arcuate bottom member and said first plate member a contained cavity within said scoop.

5. An end effector according to claim 1, wherein said opposed lateral side walls each includes a side wall edge and said curved arcuate bottom member includes a scoop edge spanning between said lateral side walls, wherein at least one of said edges comprises at least one edge indentation whereby when said edge indentation is positioned adjacent said first or second plate member, an article may be grasped by being contained within said at least one edge indentation.

6. An end effector according to claim 1, wherein said curved arcuate bottom member includes a scoop edge spanning between said lateral side walls, said scoop edge including at least one scoop indentation whereby when said scoop edge is positioned adjacent said first or second plate member, an article may be grasped by being contained within said scoop indentation.

7. An end effector carried by a supporting arm, comprising:

a. a pair of spaced apart mounting means extending from said supporting arm to said end effector, said end effector comprising a first plate member held at an orientation relative to said support arm;

b. a rotatable scoop rotatably mounted by said mounting means, spaced from said support arm in a manner such that said scoop is rotatable through a 360 degree arc, said scoop having a pair of opposed lateral side walls and a curved arcuate bottom defining an obstruction free arcuately shaped open ended scoop, said scoop being adapted to rotate through said 360 degree arc with said first plate being dimensioned to span the width between said side walls of said scoop; and c. actuation means for rotating said rotatable scoop portion through said 360 degree arc.

8. An end effector according to claim 7, wherein said first plate portion is adjustably mounted with respect to said supporting arm for positioning in selected fixed orientations therewith.

9. An end effector according to claim 7, said end effector including a hinged rotatable second plate member mounted by said support arm.

10. A method of gathering loose material from a substrate comprising:

1) providing a rotatable open ended scoop having a pair of opposed lateral side walls and a curved arcuate bottom wall member, said scoop being moveable about a fixed axis through at least a portion of an arc, in combination with a first plate extendable between a first non-substrate engaging position and a second substrate engaging position with said first plate being positionable between said lateral side walls;

2) positioning said scoop at a point displaced from said substrate surface;

3) effecting movement of said first plate from said first non-substrate engaging position to said second substrate engaging position wherein said first plate penetrates into said substrate at a fixed point;

4) effecting relative movement of said scoop with respect to said first plate in said substrate engaging position to permit engagement and penetration of said substrate surface by said curved arcuate bottom member of said scoop, said scoop rotating about the fixed axis to thereby gather substrate material in said scoop between said lateral side walls and said curved arcuate bottom wall member during rotation of said scoop, said rotational movement of said scoop being effected to an extend such that said first plate in said extended position is within the lateral side walls of said scoop to thereby provide an end closure for said scoop;

5) removing said scoop with said first plate between said lateral side walls from said substrate together with gathered substrate material contained therein, and further, providing in combination with said rotatable scoop a second plate member rotatably carried by said supporting arm for movement about a second plate axis; and (6) moving said second plate member about said second plate axis from a first non-substrate containing position to a second substrate containing position with said plate being positioned relative to said pair of lateral side walls to form an enclosed scoop volume with gathered substrate material contained therein.

11. A method according to claim 10, further including the step of discharging said gathered substrate material from said scoop, by rotating said scoop such that said lateral side walls of said scoop are moved to permit said gathered substrate material to be discharged from at least one side of said bottom wall member.

12. A method according to claim 10, further including the step of discharging said substrate material by rotating said scoop to create space between either said first or second plate and said curved arcuate bottom wall member whereby said gathered material may be discharged through said space at a controlled rate.

13. A method of grasping an article comprising:

(1) providing a rotatable open ended scoop having a pair of opposed lateral side walls each with side edges and a curved arcuate bottom wall with end edges said scoop having at least one article retaining indentation formed along at least one of the edges of the edges formed on said side walls and bottom wall, said scoop being moveable about a fixed axis through at least a portion of an arc, said scoop having a plate extendable between a first non-article engaging position and a second article engaging position with said plate being positionable between said lateral side walls;

(2) providing an article having at least one engagement surface;

(3) positioning said scoop at a point displaced from said article;

(4) effecting movement of said plate from said first non-article engaging position to said second article engaging position wherein said plate is adjacent said article;

(5) effecting relative movement of said scoop with respect to said plate in said article engaging position to permit engagement of said article engagement surface by said article-retaining indentation and effect grasping of said article.

14. A method according to claim 13, including the step of providing a pair of article retaining indentations in the side edges of said respective side walls, and engaging an article having two engagement surfaces so that said respective engagement surfaces are respectively grasped by said pair of article retaining indentations.

15. An actuatable assembly comprising an end effector carried by a supporting arm, in combination with a graspable article, said assembly further comprising:

1. mounting means extending between the support arm and said end effector;
2. a first plate member carried by said end effector so as to be held at an orientation relative to said support arm;
3. a rotatable scoop rotatably mounted about an axis on said support arm, said scoop having a pair of opposed lateral side walls and a curved arcuate bottom member defining an obstruction free, arcuately-shaped, open-ended scoop, said scoop being adapted to rotate through at least a portion of an arc to allow said first plate member to span said opening of said scoop between said lateral side walls, said opposed lateral side walls of the scoop each including a side wall edge and said curved arcuate bottom member including a scoop edge spanning between said lateral side walls, at least one of said edges of the scoop comprising at least one edge indentation;
4. actuation means for rotating said rotatable scoop portion member about said axis; and
5. a graspable article having at least one engagement surface dimensioned to be engaged by said at least one edge indentation whereby, with said at least one edge indentation positioned adjacent said first plate member with said engagement surface embraced by said at least one indentation, said article is grasped by being contained between said at least one edge indentation and said plate member.

16. An end effector according to claim 15, wherein said rotatable scoop portion is moveable about its axis in an arc that equals or exceeds 360 degrees.

17. An end effector according to claim 15, wherein said graspable article and said end effector comprise complementary inter-engageable electrical connectors that interconnect when said at least one engagement surface is contained by said at least one edge indentation.

18. An end effector according to claim 16, wherein said graspable article and said end effector comprise complementary inter-engageable electrical connectors that interconnect when said at least one engagement surface is contained by said at least one edge indentation.

* * * * *

UNITED STATES PATENT AND TRADEMARK OFFICE

CERTIFICATE OF CORRECTION

PATENT NO. : 6,341,933 B1 
DATED : January 29, 2002
INVENTOR(S) : Eric Gagnon and Bruno Rubinger It is certified that error appears in the above-identified patent and that said Letters Patent is hereby corrected as shown below:

Title page,
Item [73], Assignee, the spelling of the Assignee's name has been corrected to read:

-- MacDonald Dettwiler Space & Advanced Robotics Limited --

Signed and Sealed this

Seventeenth Day of September, 2002

*Attest:*

*Attesting Officer*

JAMES E. ROGAN
*Director of the United States Patent and Trademark Office*